US010033110B2

(12) United States Patent
Moon et al.

(10) Patent No.: US 10,033,110 B2
(45) Date of Patent: Jul. 24, 2018

(54) MULTI-BAND, MULTI-POLARIZED WIRELESS COMMUNICATION ANTENNA

(71) Applicant: KMW Inc., Hwaseong, Gyeonggi-Do (KR)

(72) Inventors: Young-Chan Moon, Gyeonggi-do (KR); Sung-Hwan So, Gyeonggi-do (KR); Soon-Wook Kim, Gyeonggi-do (KR); Jae-Hwan Lim, Seoul (KR); Seong-Ha Lee, Incheon (KR)

(73) Assignee: KMW INC., Hwaseong, Gyeonggi-do (KR)

( * ) Notice: Subject to any disclaimer, the term of this patent is extended or adjusted under 35 U.S.C. 154(b) by 0 days.

(21) Appl. No.: 15/143,976

(22) Filed: May 2, 2016

(65) Prior Publication Data

US 2016/0248166 A1 Aug. 25, 2016

Related U.S. Application Data

(63) Continuation of application No. PCT/KR2014/010245, filed on Oct. 29, 2014.

(30) Foreign Application Priority Data

Nov. 5, 2013 (KR) ..... 10-2013-0133584

(51) Int. Cl.
*H01Q 21/00* (2006.01)
*H01Q 19/10* (2006.01)
(Continued)

(52) U.S. Cl.
CPC ..... *H01Q 19/10* (2013.01); *H01Q 1/246* (2013.01); *H01Q 5/42* (2015.01); *H01Q 21/24* (2013.01); *H01Q 1/243* (2013.01)

(58) Field of Classification Search
CPC ..... H01Q 19/10; H01Q 5/42; H01Q 1/246; H01Q 21/24; H01Q 1/243
(Continued)

(56) References Cited

U.S. PATENT DOCUMENTS 6,211,841 B1 4/2001 Smith et al.
2009/0278759 A1* 11/2009 Moon ..... H01Q 1/246 343/810
(Continued)

FOREIGN PATENT DOCUMENTS

CN 103094668 A 5/2013
CN 203134986 U 8/2013
(Continued)

OTHER PUBLICATIONS

European Search Report dated Jun. 12, 2017 in corresponding European Patent Application No. 14860242.8.
(Continued)

*Primary Examiner* — Daniel J Munoz
*Assistant Examiner* — Hai Tran
(74) *Attorney, Agent, or Firm* — Mintz Levin Cohn Ferris Glovsky and Popeo, P.C.; Kongsik Kim; Jhongwoo Peck

(57) ABSTRACT

The present invention relates to a multi-band, multi-polarized wireless communication antenna, which comprises: a reflector; at least one first radiation module of a first band which is installed on the reflector; and at least one second or third radiation module of a second band or a third band installed on the reflector, wherein the first radiation module comprises first to fourth radiating elements having a dipole structure, the first to fourth radiating elements are configured such that every two radiating arms thereof are connected in the shape of letter "¬", one of the two radiating arms is configured to be placed side by side along side of the reflector, and the second or third radiation module is
(Continued)

installed to be included within an installation range of the first radiation module.

8 Claims, 19 Drawing Sheets

(51) Int. Cl.
*H01Q 21/24* (2006.01)
*H01Q 5/42* (2015.01)
*H01Q 1/24* (2006.01)

(58) Field of Classification Search
USPC ..... 343/810, 817, 835, 702
See application file for complete search history.

(56) References Cited

U.S. PATENT DOCUMENTS

| | | | |
|---|---|---|---|
| 2013/0271336 | A1 | 10/2013 | Plet et al. |
| 2013/0307743 | A1 | 11/2013 | Moon et al. |
| 2014/0139387 | A1 | 5/2014 | Jones et al. |

FOREIGN PATENT DOCUMENTS

| | | | |
|---|---|---|---|
| JP | 2005-033261 | A | 2/2005 |
| JP | 2010503356 | A | 1/2010 |
| JP | 2014-504127 | A | 2/2014 |
| KR | 10-2001-0042252 | A | 5/2001 |
| KR | 10-2007-0083723 | A | 8/2007 |
| KR | 10-2008-0023605 | A | 3/2008 |
| KR | 10-2009-0089082 | A | 8/2009 |
| KR | 10-2010-0033888 | A | 3/2010 |
| KR | 10-2013-0112518 | A | 10/2013 |

OTHER PUBLICATIONS

Japanese Notice of Allowance dated Apr. 3, 2017 in corresponding Japanese Patent Application No. JP 2016-525024.

* cited by examiner

| Curve Info | xdb 10 Beamwidth(3) |
|---|---|
| Freq='0.7GHz' Phi='90deg' | 63.09 |
| Freq='0.75GHz' Phi='90deg' | 57.42 |
| Freq='0.8GHz' Phi='90deg' | 58.08 |
| Freq='0.85GHz' Phi='90deg' | 54.56 |
| Freq='0.9GHz' Phi='90deg' | 52.79 |

| Curve Info | xdb 10 Beamwidth(3) |
|---|---|
| Freq='0.7GHz' Phi='90deg' | 56.17 |
| Freq='0.75GHz' Phi='90deg' | 54.79 |
| Freq='0.8GHz' Phi='90deg' | 53.84 |
| Freq='0.85GHz' Phi='90deg' | 51.63 |
| Freq='0.9GHz' Phi='90deg' | 48.76 |

| Curve Info | xdb 10 Beamwidth(3) |
|---|---|
| Freq='0.7GHz' Phi='90deg' | 67.58 |
| Freq='0.75GHz' Phi='90deg' | 63.00 |
| Freq='0.8GHz' Phi='90deg' | 62.40 |
| Freq='0.85GHz' Phi='90deg' | 61.23 |
| Freq='0.9GHz' Phi='90deg' | 59.59 |

MULTI-BAND, MULTI-POLARIZED WIRELESS COMMUNICATION ANTENNA

CROSS REFERENCE TO RELATED APPLICATIONS

This application is a continuation of International Application No. PCT/KR2014/010245 filed on Oct. 29, 2014, which claims priority to Korean Application No. 10-2013-0133584 filed on Nov. 5, 2013, which applications are incorporated herein by reference.

TECHNICAL FIELD

The present invention relates to a wireless communication antenna used by a base station or a relay in a wireless communication (PCS, Cellular, CDMA, GSM, LTE, etc.) system and, particularly, to a multi-band multi-polarized antenna (hereinafter, referred to as "antenna").

BACKGROUND ART

An antenna used by a base station, including a relay, in a wireless communication system may have various shapes and structures. Recently, in a wireless communication antenna, a dual-polarized antenna structure has been generally used by applying a polarization diversity scheme.

Usually, a dual-polarized antenna has a structure in which four radiation elements having the shape of a dipole, as one radiation module, are properly arranged, in the shape of a tetragon or in the shape of a rhombus, on at least one longitudinally upright reflector. The four radiation elements, for example, radiation elements catty-cornered from each other make a pair and respective pairs of radiation elements are arranged +45 to −45 degrees with respect to verticality (or horizontality) and are used, for example, in transmitting (or receiving) the corresponding one of two linear polarizations, which are orthogonal to each other. Further, multiple radiation modules, each of which includes the four dipole-shaped radiation elements, are usually arranged vertically on the reflector so as to form one antenna array.

Further, an example of such a dual-band polarized antenna is disclosed in KR Patent Application No. 2000-7010785 (Title: "Dual-Polarized Dual-Band Antenna", Filed Date: Sep. 28, 2000) first filed by Kathrein-Verke A G, or in KR Patent Application No. 2008-92963 (Title: "Dual-Polarized Dual-Band Antenna for a Mobile Communication Base Station", Filed Date: Sep. 22, 2008) first filed by the present applicant.

In a multi-band antenna, multiple antennal arrays, according to each band, are installed on one reflector. For example, in order to implement a tri-band antenna, a total of three antenna arrays, one for each band, should be installed. In order to seek the best method for installing multiple antenna arrays as described above, an arrangement structure of an antenna array for each band, a structure of radiation modules constituting antenna arrays for each band, and an effect by mutual interference between antenna arrays for each band should be considered. At this time, the radiation performance of antenna arrays should be ensured while making the entire size of the antenna as small as possible. However, it is considerably difficult to design an antenna that satisfies such conditions in a limited space (on one reflector).

Therefore, various studies are currently being carried out on the more optimized structure of a multi-band multi-polarized antenna, the optimization of the size of an antenna, a stable radiation characteristic, the easy adjustment of beam width, an easy antenna design, etc.

SUMMARY

Therefore, the purpose of the present invention is to provide a multi-band multi-polarized wireless communication antenna having the more optimized structure, optimized size, the stable radiation characteristic, the easy beam width adjustment, and the easy antenna design.

In order to achieve the above-described purpose, the present invention provides a multi-band multi-polarized wireless communication antenna, which includes: a reflector; a first radiation module of a first band, which is installed on the reflector; and a second or third radiation module of a second or third band, which is installed on the reflector, wherein the first radiation module includes first to fourth radiation elements having a dipole structure, each of the first to fourth radiation elements is configured such that two radiation arms are connected to each other in the shape of letter "¬", one of the two radiation arms is configured to be placed parallel to and along a side the reflector, and wherein the second or third module is installed to be included in an installation range of the first radiation module.

In the above description, one of the fifth to eighth radiation elements, each of which is configured such that two radiation arms are connected to each other in the shape of the letter "¬", is included inside the first radiation module and the fifth to eighth radiation elements may be installed to form a structure of the overall shape of the letter "+".

In the above description, at least one 1-2th radiation module of the first band which is installed on the reflector is further included; and the at least one 1-2th radiation module may be combined with the first radiation module so as to implement an antenna array of the first band.

In the above description, a feeding network may be formed so that at least some of radiation elements catty-cornered from each other in the first radiation module are linked with each other to generate one of X polarized waves, respectively.

In the above description, a feeding network may be formed so that at least some of the radiation elements catty-cornered from each other in the first radiation module are linked to generate the first to forth polarized waves, respectively.

In the above description, each of the first to fourth radiation elements of the first radiation module may form a feed network so as to generate the first to fourth polarize waves, respectively.

In the above description, when the fifth to eighth radiation elements are installed correspondingly to the first to fourth radiation elements respectively, the first and fifth radiation elements may be configured to generate a first polarized wave, the second and sixth radiation elements may be configured to generate a second polarized wave, the third and seventh radiation elements may be configured to generate a third polarized wave, and the fourth and eighth radiation elements may be configured to generate a fourth polarized wave.

In the above description, the first and seventh radiation elements may be configured to generate a first polarized wave, the second and eighth radiation elements may be configured to generate a second polarized wave, the third and fifth radiations may be configured to generate a third polarized wave, and the fourth and sixth radiation elements may be configured to generate a fourth polarized wave.

DETAILED DESCRIPTION

Figure 1:
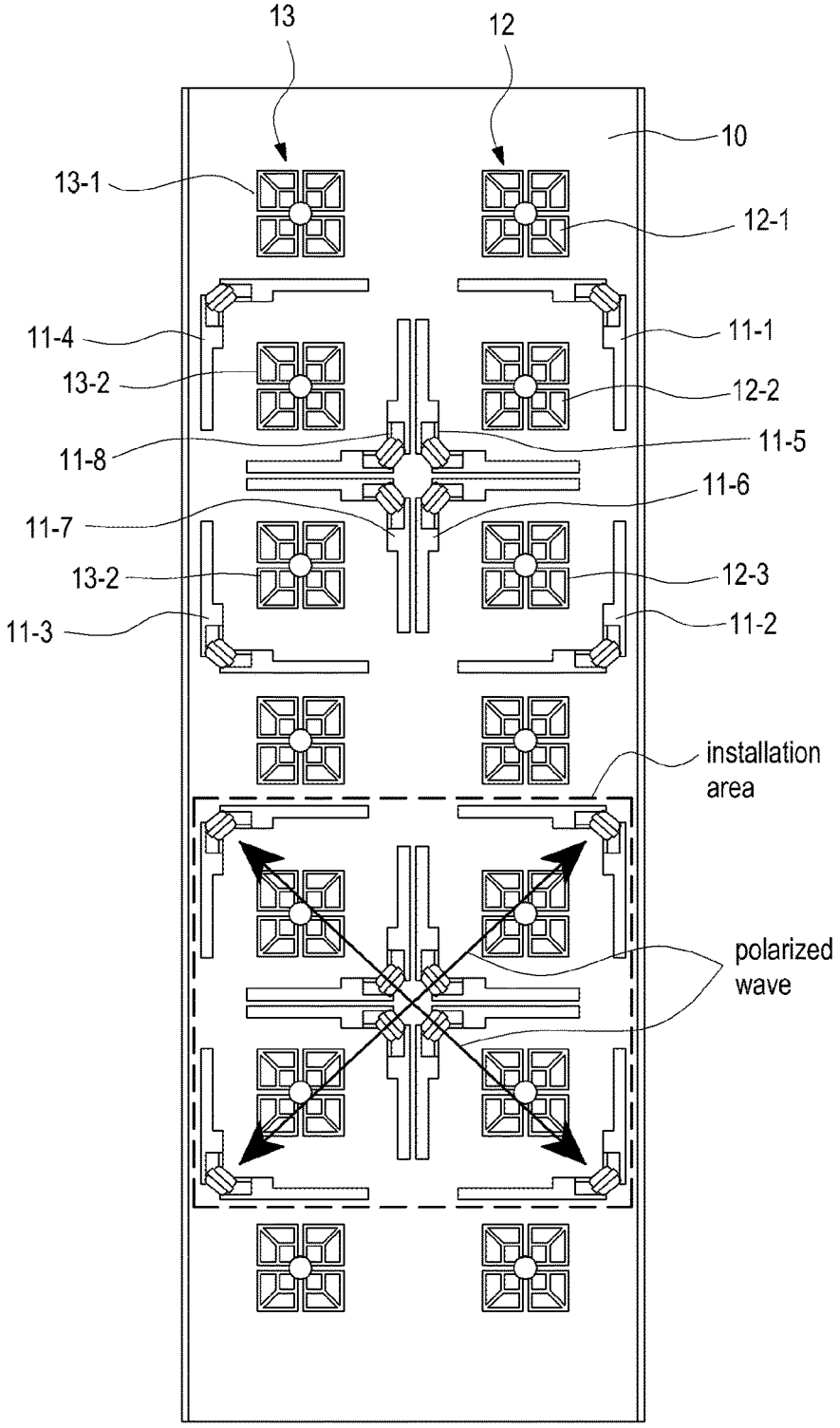
FIG. 1 is a plane structure view of a multi-band multi-polarized wireless communication antenna according to the first embodiment of the present invention.

Hereinafter, an exemplary embodiment according to the present invention will be described in detail with reference to the accompanying drawings. In the following description, identical elements are provided with an identical reference numeral where possible. Various specific definitions found in the following description are provided only to help general understanding of the present invention, and it is apparent to those skilled in the art that the present invention can be implemented without such definitions.

Figure 2:
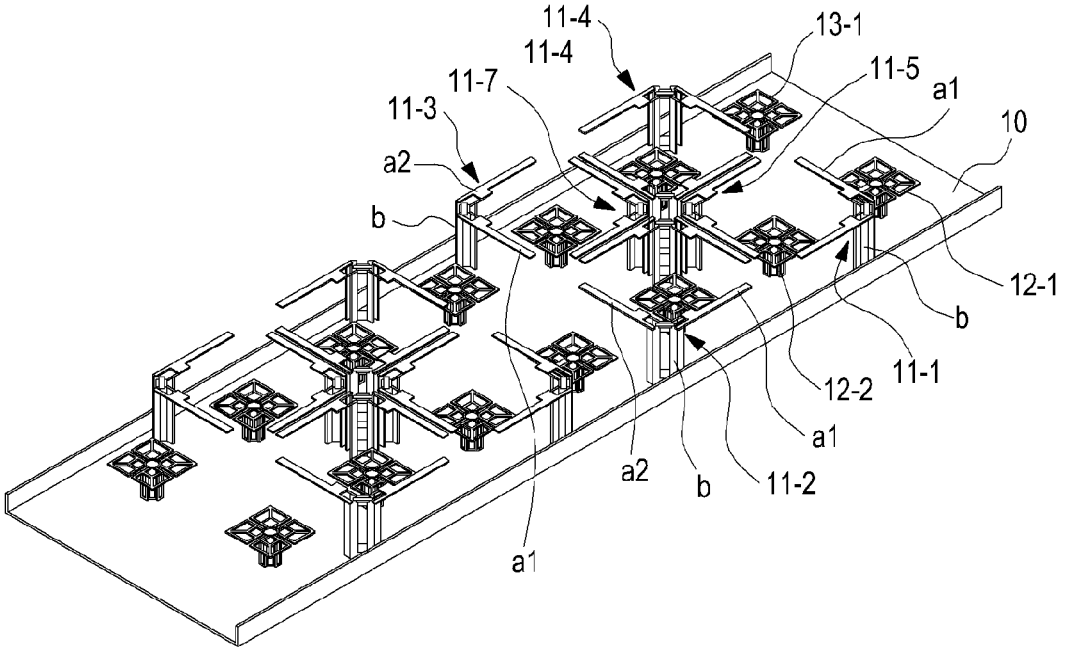
FIG. 2 is a perspective view of a wireless communication antenna.
Figure 3:
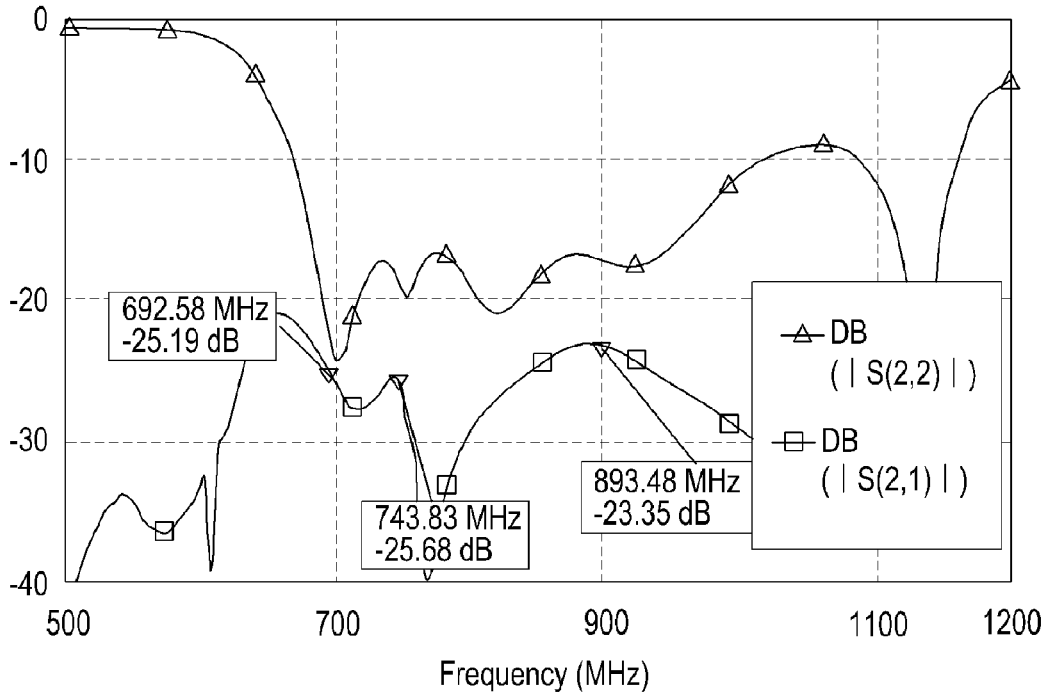
FIGS. 3 and 4 are characteristic graphs of a first radiation module in the wireless communication antenna of FIG. 1.
Figure 4:
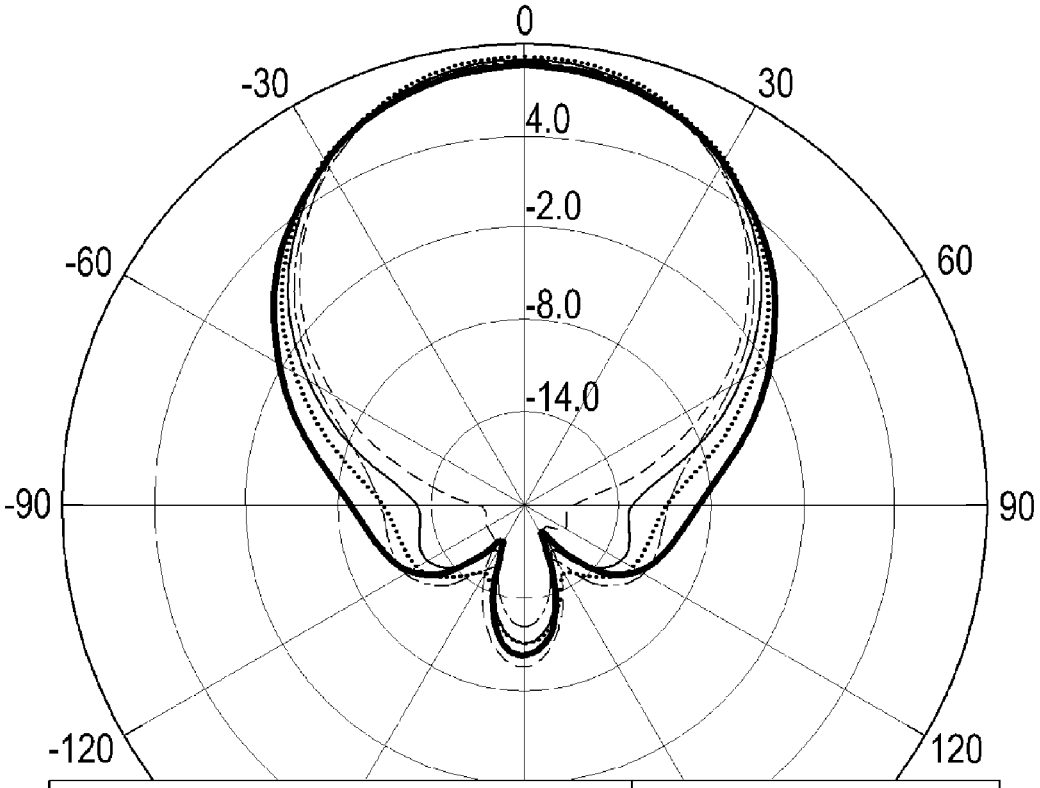

FIG. 1 is a plane structure view of a multi-band multi-polarized wireless communication antenna according to the first embodiment of the present invention, FIG. 2 is a perspective view of a wireless communication antenna, and FIGS. 3 and 4 are characteristic graphs of a first radiation module in the wireless communication antenna of FIG. 1 and show an S-parameter characteristic and a radiation pattern characteristic, respectively.

Referring to FIGS. 1 to 4, an antenna according to the first embodiment of the present invention has a structure in which one or more first radiation modules 11 (11-1, 11-2, 11-3, 11-4, 11-5, 11-6, 11-7, 11-8) of a first frequency band (e.g., 700-900 MHz bands), which is a relatively low frequency band, and one or more second and third radiation modules 12 and 13 of a second frequency band (e.g., about 2 GHz band) and a third frequency band (e.g., about 2.5 GHz band), which are relatively high frequency bands, are arranged on one reflector 10. At this time, each of the first to third radiation modules (11, 12, 13) may be configured to generate an X polarized-wave of the corresponding band.

The second and third radiation modules 12 and 13 can be implemented as a radiation module that includes generally used radiation elements having various structures and shapes, including a general radiation element having the shape of a dipole. However, the first radiation modules 11 have a characteristic structure according to an embodiment of the present invention.

The first radiation module 11 includes eight first to eighth radiation elements 11-1 to 11-8 having a dipole structure. At this time, similar to a general dipole structure, the four outer first to fourth radiation elements 11-1 to 11-4 includes two radiation arms a1 and a2, each of which is supported by a support b having a balloon structure. The two radiation arms a1 and a2 are connected to be, for example, perpendicular to each other and one of the two radiation arms a1 and a2 is placed parallel to and along a side edge of the reflector 10 on which the corresponding radiation element is installed. In other words, depending on such a configuration, the plane structure of each of the four radiation elements 11-1 to 11-4 has the shape of letter "¬" and the overall outer structure of the four radiation elements 11-1 to 11-4 has the shape of a tetragon, the left and right sides of which are parallel to side surfaces of the reflector 10.

Further, each of the four fifth to eighth radiation elements 11-5 to 11-8 inside the first radiation modules 11 may also have the same configuration as the first to fourth radiation elements (11-1 to 11-4). However, the fifth to eighth radiation elements 11-5 to 11-8 are arranged in the overall shape of the letter "+" with reference to the overall center of the corresponding first radiation modules 11. In other words, in the case of the fifth to eighth radiation elements 11-5 to 11-8, the radiation elements adjacent to each other are arranged side by side at the corresponding radiation arms.

In the above-described structure, in the first radiation modules 11 having the overall outer shape of a tetragon, a feeding network (not illustrated) is formed so that radiation elements, which are arranged in a diagonal direction, are linked with each other to generate one of X polarized waves, respectively. In other words, the feeding network is formed so that the first, third, fifth, and seventh radiation elements 11-1, 11-3, 11-5, and 11-7 are linked with each other and the second, fourth, sixth, and eighth 11-2, 11-4, 11-6, and 11-8 are linked with each other.

Examining the above-described structure, it can be known that the reflector 10 can be designed to have the minimum size, without an area substantially extending to the outside beyond an installation area of the first to fourth radiation elements 11-1 to 11-4 of the first radiation module 11. In such a structure, it can be known that the structure of the first radiation module 11 of a low frequency band utilizes, to the utmost, an area of the reflector 10 which serves as a ground, the overall size of the first radiation module being large; the separation distance between the first to fourth radiation elements 11-1 to 11-4 of the first radiation module 11 is maximized; the shape of radiation arms of the first to fourth radiation elements 11-1 to 11-4 is formed to be the same as the shape of a side edge part of the reflector 10; and an antenna having the narrow beam width (about beam width of 60 degrees or less) is thereby formed. In other words, as specifically shown in FIG. 4, the first radiation module 11 has a characteristic of the narrower beam width than the beam width (the beam width of about 65 degrees or the wide beam width of 70 degrees or more) of a radiation module having a general structure.

Here, broadband characteristics can be implemented by using a mutual combination between the fifth to eighth radiation elements 11-5 to 11-8 arranged in the inside.

Further, the horizontal beam width can be formed by properly adjusting and designing an arrangement interval between the first to fourth radiation elements 11-1 to 11-4 arranged in the outside and the fifth to eighth radiation elements 11-5 to 11-8 arranged in the inside.

Meanwhile, as in FIGS. 1 and 2, when multiple second and third radiation modules 12 and 13 are vertically arranged and form antenna arrays of corresponding bands respectively, the second and third radiation modules share an installation space of the first radiation module 11 and, two second radiation modules and two third radiation modules are installed to be included in an installation range of the first radiation module 11. Here, the first radiation module 11, which includes the first to eighth radiation elements 11-1 to 11-8, has, in the structure, empty areas of a quadrant formed on upper and lower right surfaces and on upper and lower left surfaces. Each of such empty areas, for example, the upper and lower right surfaces may be configured to have one second radiation module 12 (12-2 and 12-3 in the example of FIG. 1) installed thereon and each of the upper and lower left surfaces may be configured to have one third radiation module 13 (13-2 and 13-3 in the example of FIG. 1) installed thereon.

Such an arrangement structure of the first to third radiation modules 11, 12, and 13 can minimize the size of an overall arrangement space and minimize an effect which radiation elements of radiation modules of different bands have on each other.

Figure 5:
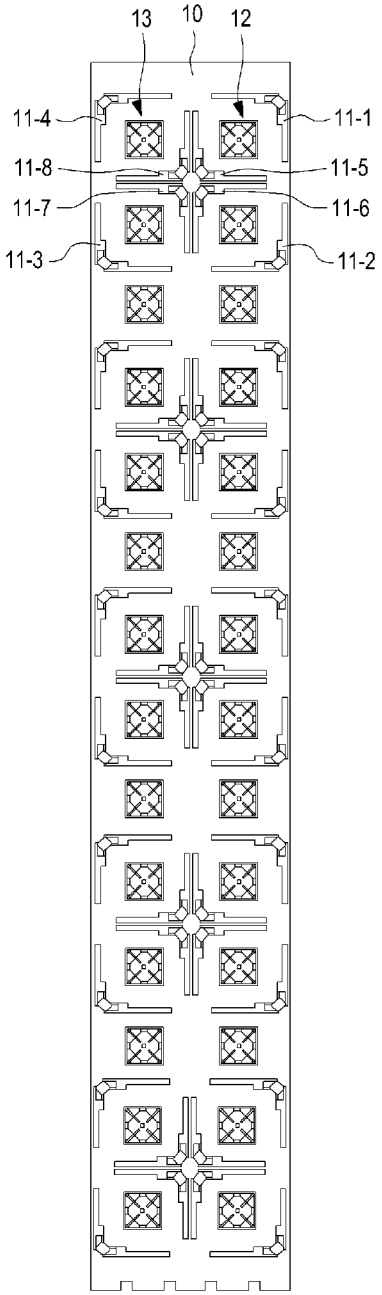
FIGS. 5 to 7 are plane views illustrating modified structures of the wireless communication antenna of FIG. 1.
Figure 6:
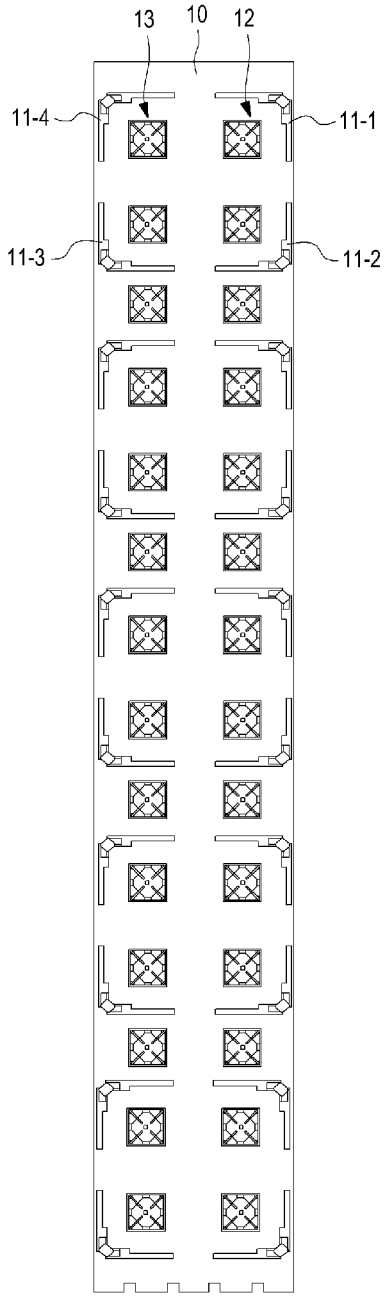
Figure 7:
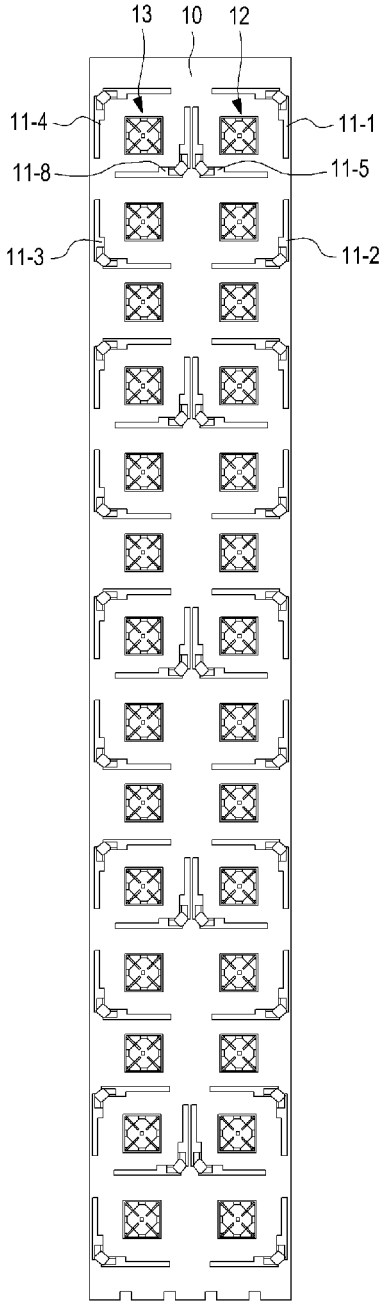

FIGS. 5 to 7 are plane views illustrating modified structures of the wireless communication antenna of FIG. 1. Firstly, the structure of the first to third radiation modules 11, 12, and 13 in the modified structure illustrated in FIG. 5 is the same as the structure illustrated in FIG. 1. However, FIG. 5 illustrates a structure in which, in order to form an overall antenna, for example, five first radiation modules 11 are provided on the reflector 10 so as to form one antenna array as a whole.

Unlike the structure illustrated in FIG. 5, in the modified structure illustrated in FIG. 6, a first radiation module 11 is implemented only by the outer first to fourth radiation elements 11-1 to 11-4 and does not includes the inner fifth to eighth radiation elements 11-5 to 11-8. In this case, a feeding network is formed so that radiation elements catty-cornered from each other in the first radiation module 11 having the overall shape of a tetragon, for example, the first and third radiation elements 11-1 and 11-3 are linked with each other and the second and fourth radiation elements 11-2 and 11-4 are linked with each other, thereby generating an X polarized wave.

Unlike the structure illustrated in FIG. 5, in the modified structure illustrated in FIG. 7, the first radiation module 11 includes only the inner fifth and eighth radiation elements 11-5 and 11-8 together with the outer first to fourth radiation elements 11-1 to 11-4, but does not include the sixth and seventh radiation elements 11-6 and 11-7. In this case, a feeding network is formed so that the first, third, and fifth radiation elements 11-1, 11-3, and 11-5 are linked with each other and the second, fourth, and eighth radiation elements 11-2, 11-4, and 11-8 are linked with each other.

Figure 8:
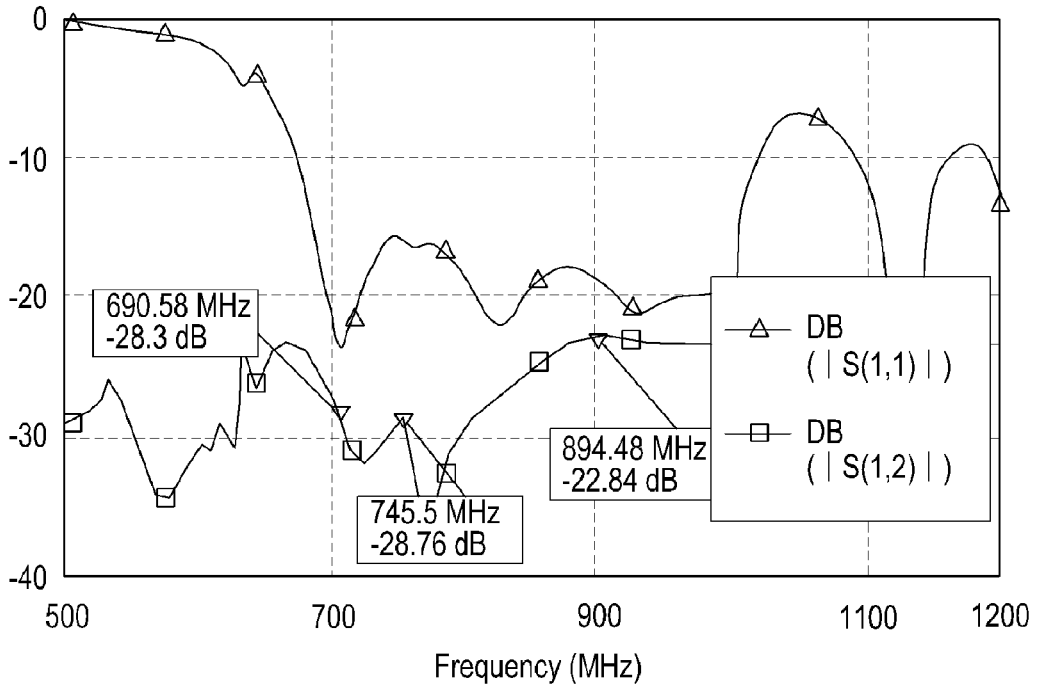
FIGS. 8 and 9 are characteristic graphs of a first radiation module in the wireless communication antenna of FIG. 7.
Figure 9:
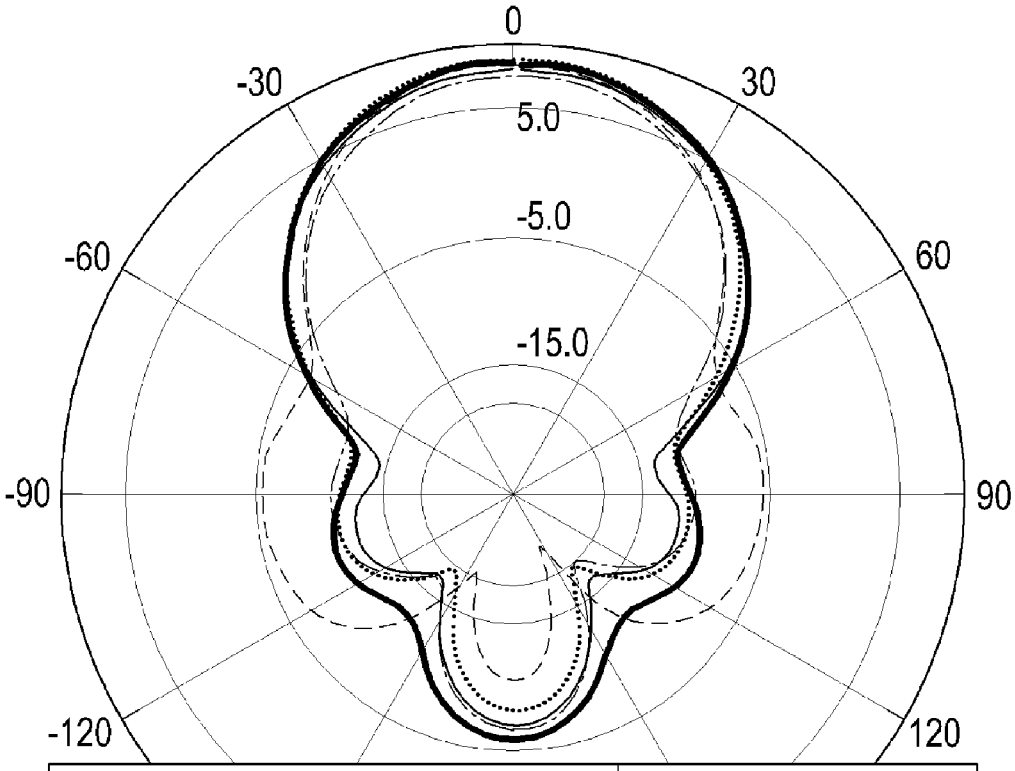

FIGS. 8 and 9 are characteristic graphs of a first radiation module in the wireless communication antenna of FIG. 7 and show an S-parameter characteristic and a radiation pattern characteristic, respectively. As in FIGS. 8 and 9, it can be known that such modified structures also have a fully satisfactory characteristic. As described above, a design can be made to properly and differently arrange or include radiation elements inside the first radiation module 11, thereby forming a characteristic, such as a horizontal beam width of a radiation pattern.

Figure 10:
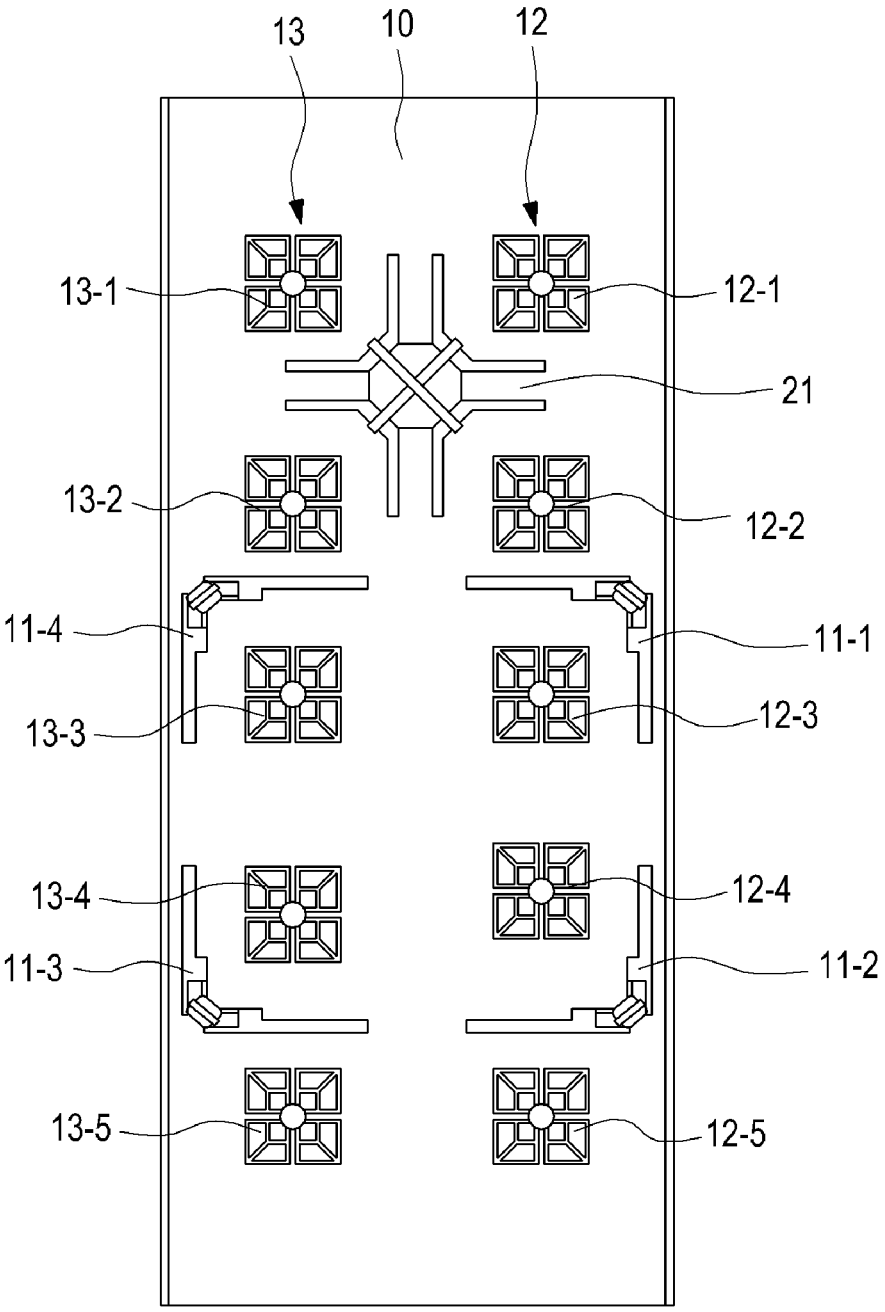
FIG. 10 is a plane structure view of a multi-band multi-polarized wireless communication antenna according to the second embodiment of the present invention.
Figure 11:
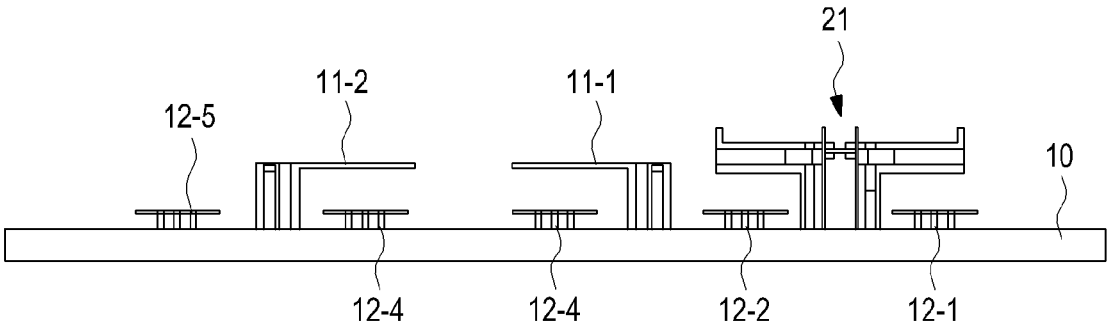
FIG. 11 is a side view of the wireless communication antenna of FIG. 10.

FIG. 10 is a plane structure view of a multi-band multi-polarized wireless communication antenna according to the second embodiment of the present invention, and FIG. 11 is a side view of the wireless communication antenna of FIG. 10. Referring to FIGS. 10 and 11, similar to the structure of the first embodiment illustrated in FIG. 1, the antenna according to the second embodiment of the present invention has a structure in which first radiation modules 11 (11-1, 11-2, 11-3, and 11-4) of a first frequency band and second and third radiation modules 12 and 13 of second and third frequency bands are arranged on one reflector 10. Here, like the modified structure of the first embodiment illustrated in FIG. 6, the first radiation modules 11 may include only the outer first to fourth radiation elements 11-1 to 11-4. In addition, the first radiation modules 11 illustrated in FIG. 10 may be implemented similar to the first embodiment illustrated in FIGS. 1 and 7 and the modified structures thereof.

In the above-described structure, multiple, for example, five second and third radiation modules 12 and 13 are vertically arranged to form antenna arrays according to the corresponding second and third bands, respectively, and some (e.g., 12-3, 12-4, 13-3, and 13-4) of the five second and third radiation modules are installed to be included in the installation space of the first radiation modules 11.

In implementing antenna arrays of a first band, the antenna arrays of the first band are not to be implemented by only the first radiation module 11 having the structure of embodiments of the present invention and are implemented through a 1-2th radiation module 21, which is vertically arranged together with the first radiation module 11 and has a structure that is different from the first radiation module 11. The 1-2th module 21 can be implemented as a radiation module which includes generally used radiation elements having various structures and shapes, including a general radiation element having the shape of a dipole.

The above-described structure is in order to make a design for allowing a beam width characteristic of an antenna array of the first band to be properly adjusted. In other words, for example, by combining the 1-2th radiation module 21, which has a general structure and may have a relatively wide beam width (e.g., 70 degrees or more), and the first radiation module 11, which is designed to have a relatively narrow beam width, so as to form one antenna array of the first band, it is possible to properly adjust and design the overall beam width of an antenna of a first band to have a desired beam width characteristic.

Figure 12:
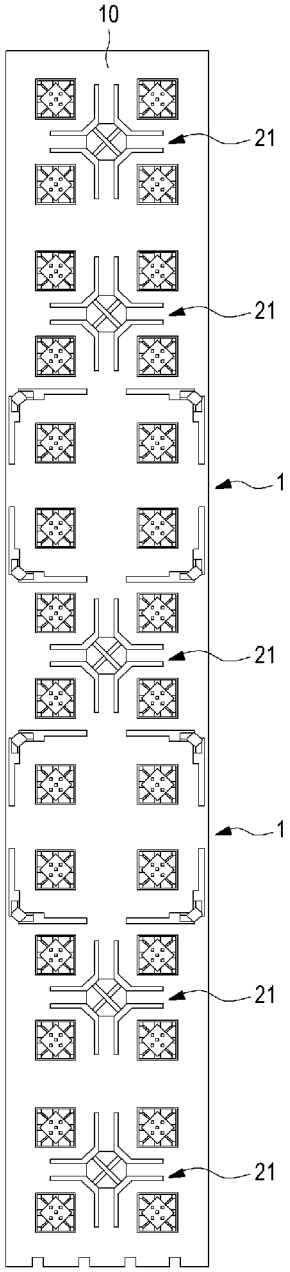
FIGS. 12 and 13 are plane views illustrating modified structures of the wireless communication antenna in FIG. 10.
Figure 13:
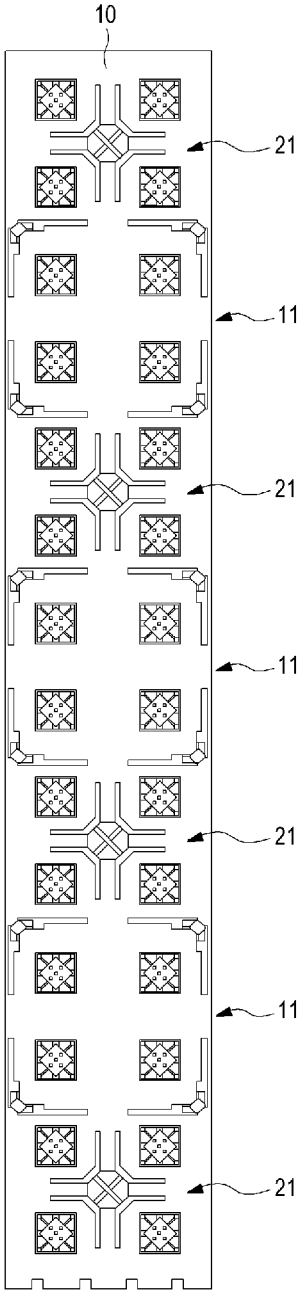

FIGS. 12 and 13 are plane views illustrating modified structures of the wireless communication antenna in FIG. 10. Firstly, referring to FIG. 12, in the modified structure illustrated in FIG. 12, it is illustrated that two first radiation modules 11 and five 1-2th radiation modules 21 are provided in order to form an antenna array of a first band on one reflector. In the modified structure illustrated in FIG. 13, it is illustrated that three first radiation modules 11 and four 1-2th radiation modules 21 are provided in order to form an antenna array of a first band on one reflector. According to the above-described structures, the entire horizontal beam width of the antenna array of the first band is more narrowly formed in the modified structure illustrated in FIG. 13, compared with the modified structure illustrated in FIG. 12.

Examining the structure of the second embodiment illustrated in FIGS. 10 to 13, it can be known that two kinds of radiation modules (i.e., the first radiation module and the 1-2th radiation module) are combined according to any configuration ratio in order to implement an antenna array of the same band, i.e. of the first band. Here, when one kind of radiation module (i.e., the 1-2th radiation module) is designed to have a wide horizontal beam width (70 degrees or more) characteristic and the other kind radiation module (i.e., the first radiation module) is designed to have a narrow horizontal width (60 degrees or less) characteristic, it is possible to implement a desired horizontal beam width by adjusting the configuration ratio of the two kinds of radiation modules and to relatively easily design the form of a radiation pattern in a limited space.

Figure 14:
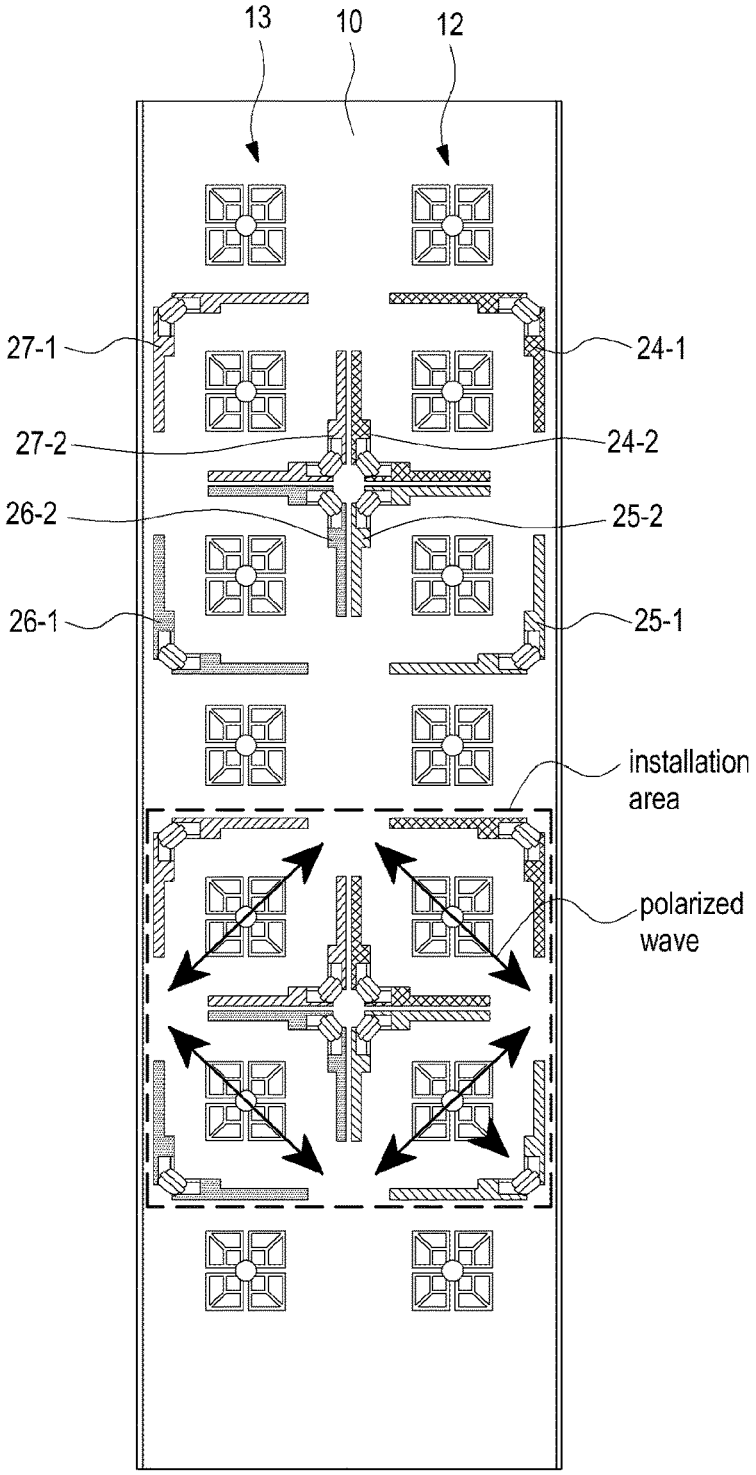
FIG. 14 is a plane structure view of a multi-band multi-polarized wireless communication antenna according to the third embodiment of the present invention.
Figure 15:
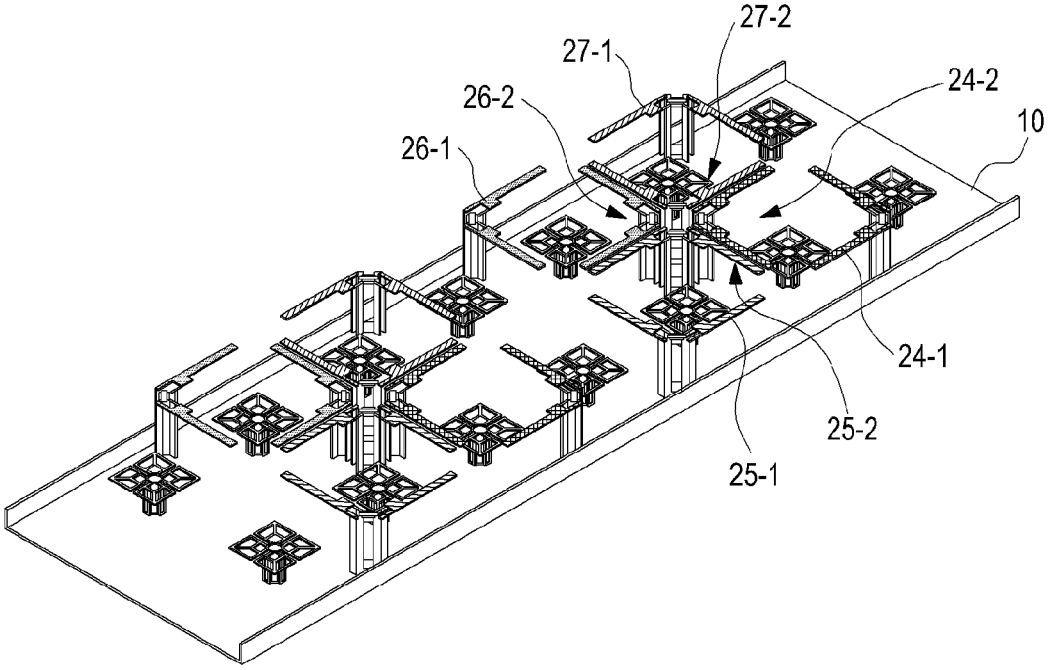
FIG. 15 is a perspective view of a wireless communication antenna.
Figure 16:
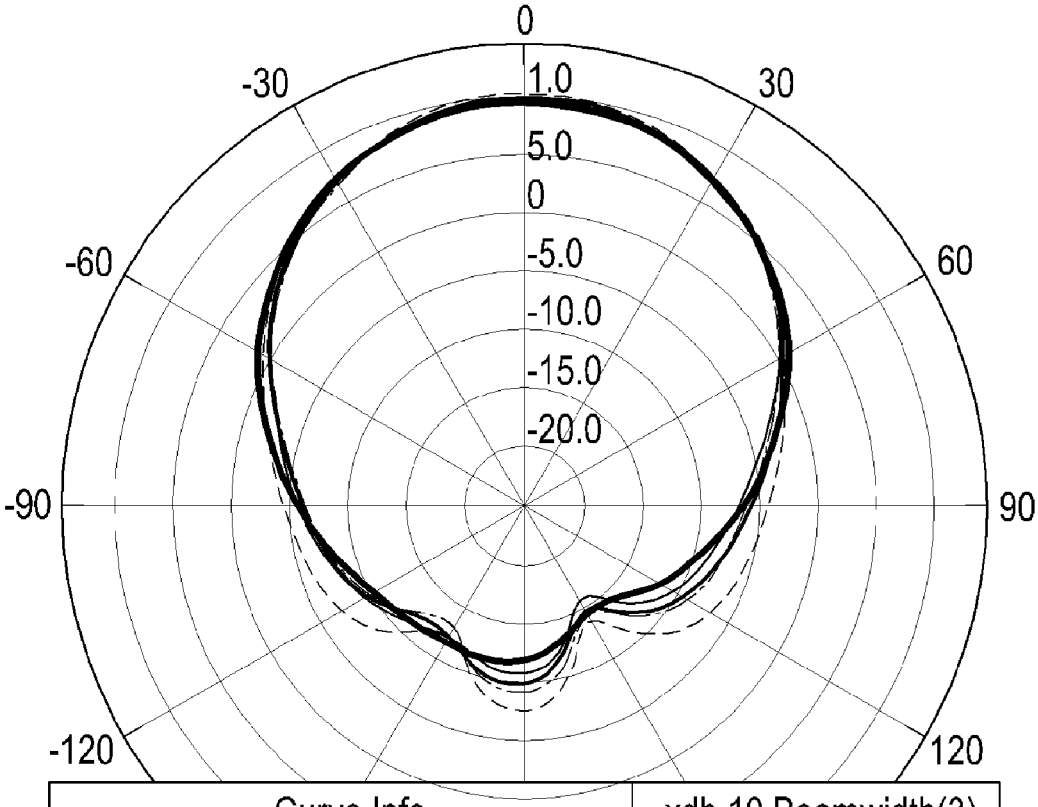
FIG. 16 is a graph showing properties of a first radiation module in the wireless communication antenna of FIG. 14.

FIG. 14 is a plane structure view of a multi-band multi-polarized wireless communication antenna according to the third embodiment of the present invention, FIG. 15 is a perspective view of the wireless communication antenna in FIG. 14, and FIG. 16 is a characteristic graph of a first radiation module in the wireless communication antenna of FIG. 14 and shows a radiation pattern characteristic. Referring to FIGS. 14 to 16, similar to the structure of each radiation module of the first embodiment illustrated in FIG. 1 and the arrangement structure thereof, the antenna according to the third embodiment of the present invention has a structure in which one or more first radiation modules 24-1, 24-2, 25-1, 25-2, 26-1, 26-2, 27-1, and 27-2 of a first frequency band and one or more second and third radiation modules 12 and 13 of second and third frequency bands, which are relatively high frequency band, are arranged on one reflector 10.

Similar to the structure of the first embodiment, the overall plane structure of each of multiple radiation elements 24-1, 24-2, 25-1, 25-2, 26-1, 26-2, 27-1, and 27-2, which form the first module, is configured to have the shape of a letter "¬", wherein each of the multiple radiation elements has two radiation arms perpendicular to each other. Further, similar to the structure of the first embodiment, in the overall structure of the first radiation module, 1-1th, 2-1th, 3-1th, and 4-1th radiation elements 24-1, 25-1, 26-1, and 27-1 are arranged to form an overall tetragonal structure at the outer side and 1-2th, 2-2th, 3-2th, and 4-2th radiation elements 24-2, 25-2, 26-2, and 27-2 are arranged in the overall shape of letter "+".

Here, in the structure of the third embodiment illustrated in FIG. 14, the multiple radiation elements 24-1, 24-2, 25-1, 25-2, 26-1, 26-2, 27-1, and 27-2, which form the first radiation module, are configured to be divided into, for example, 1-1th and 1-2th radiation elements 24-1 and 24-2, 2-1th and 2-2th radiation elements 25-1 and 25-2, 3-1th and 3-2th radiation elements 26-1 and 26-2, and 4-1th and 4-2th radiation elements 27-1 and 27-2, respectively, on the basis of a generated polarized wave.

More specifically, in the above-described structure, the 1-1th and 1-2th radiation elements 24-1 and 24-2 are implemented so as to be linked with each other to be fed and are configured to generate a first polarized wave. Similarly, the 2-1th and 2-2th radiation elements 25-1 and 25-2 are configured to generate a second polarized wave, the 3-1th and 3-2th radiation elements 26-1 and 26-2 are configured to generate a third polarized wave, and the 4-1th and 4-2th radiation elements 27-1 and 27-2 are configured to generate a fourth polarized wave. Logically, such a structure can be designed so that the first to fourth polarized waves have differences in the characteristics thereof. However, in the embodiment of FIG. 14, by using such a configuration, the first frequency band may be divided into first and second sub-bands so as to generate a first and second sub-X polarized waves in each sub-band.

For example, the 1-1th and 1-2th radiation elements 24-1 and 24-2 may be configured to generate one of first sub-X polarized waves corresponding to the first band and the 4-1th and 4-2th radiation elements 27-1 and 27-2 may be configured to generate another polarized wave of the first sub-X polarized waves. In this case, the 1-1th and 1-2th radiation elements 24-1 and 24-2 and the 4-1th and 4-2th radiation elements 27-1 and 27-2, as a whole, are configured to form the first sub-X polarized waves.

Similarly, for example, the 2-1th and 2-2th radiation elements 25-1 and 25-2 may configured to generate one of second sub-X polarized waves corresponding to the first band and the 3-1th and 3-2th radiation elements 26-1 and 26-2 may be configured to generate another polarized wave of the second sub-X polarized waves. In this case, the 2-1th and 2-2th radiation elements 25-1 and 25-2 and the 3-1th and 3-2th radiation elements 26-1 and 26-2 are, overall, configured to form the second sub-X polarized waves.

In this configuration, when designing a dipole structure between the radiation elements 24-1, 24-2, 27-1, and 27-2, which form the first sub-X polarized waves, and the radiation elements 25-1, 25-2, 26-1, and 26-2, which generate the second sub-X polarized waves, the detailed structure may be slightly different in the size thereof according to a characteristic of respectively corresponding first and second sub-bands. In this case, if the detailed dipole structures of the radiation elements 24-1, 24-2, 25-1, 25-2, 26-1, 26-2, 27-1, and 27-2, which implement the first radiation module are identically implemented, it will be noted the structure may have the same radiation characteristic as the embodiment illustrated in FIG. 1, etc.

Figure 17:
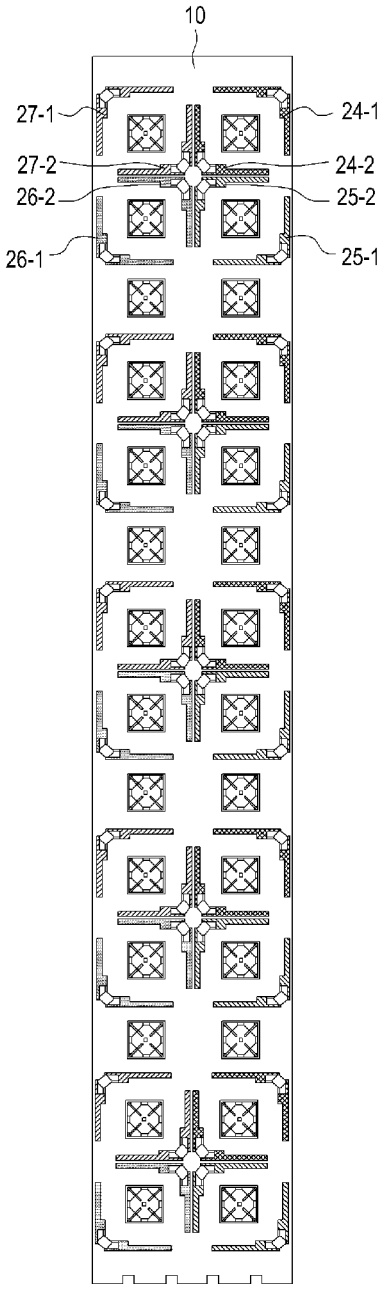
FIGS. 17 to 19 are plane views illustrating modified structures of the wireless communication antenna of FIG. 14.
Figure 18:
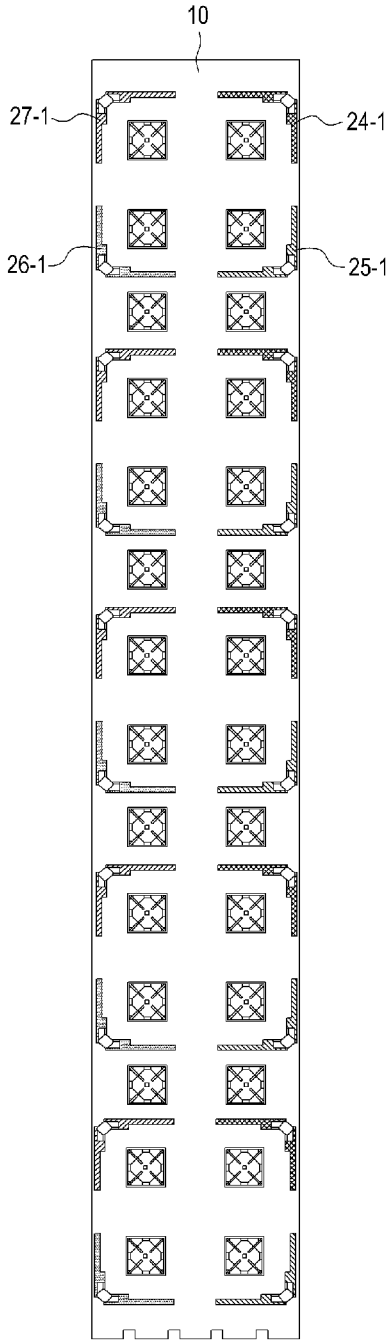
Figure 19:
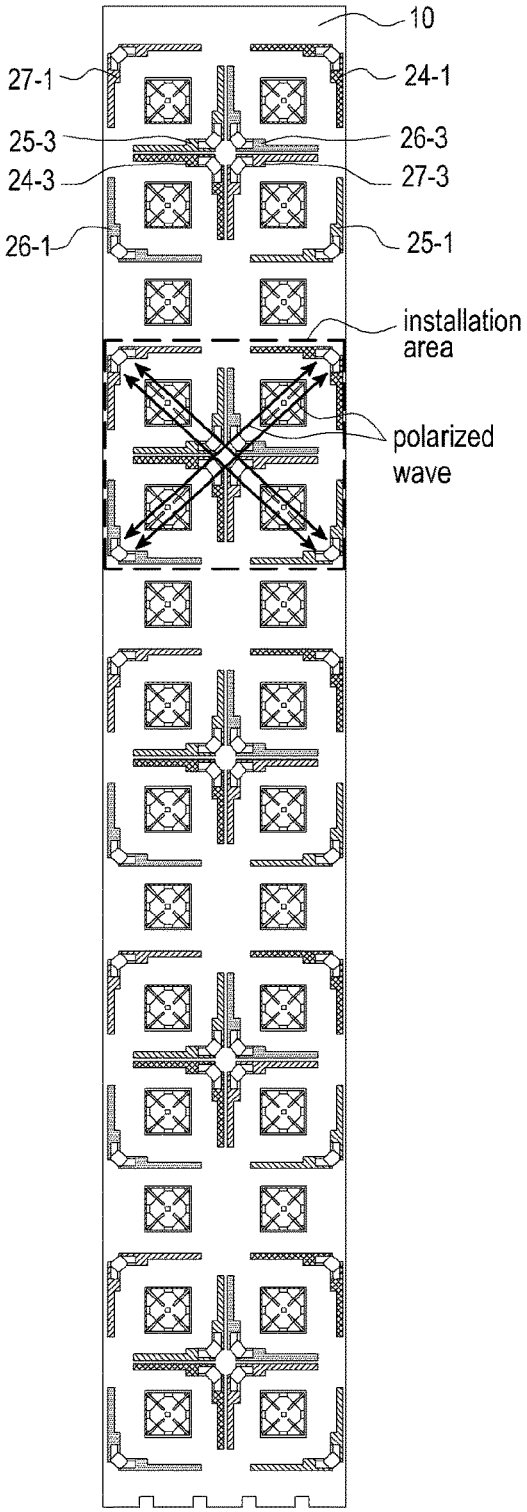

FIGS. 17 to 19 are plane views illustrating modified structures of the wireless communication antenna of FIG. 14. Firstly, the structure of the first radiation module in the modified structure illustrated in FIG. 17 is the same as the structure illustrated in FIG. 14. However, in the structure illustrated in FIG. 17, it is illustrated that, in order to form an overall antenna, for example, five first radiation modules 11 are provided on the reflector 10 so as to form one antenna array as a whole.

In the modified structure illustrated in FIG. 18, unlike the structure illustrated in FIG. 14, the first radiation module is implemented only by outer 1-1th, 2-1th, 3-1th, and 4-1th radiation elements 24-1, 25-1, 26-1, and 27-1, and does not include inner 1-2th, 2-2th, 3-2th, and 4-2th radiation elements 24-2, 25-2, 26-2, and 27-2. In this case, in the first radiation module having the overall shape of a tetragon, the 1-1th, 2-1th, 3-1th, and 4-1th radiation elements 24-1, 25-1, 26-1, and 27-1 are configured to generate a first, second, third, and fourth polarized waves, respectively.

In the modified structure illustrated in FIG. 19, the structure of the first radiation module is mostly the same as that illustrated in FIG. 14. In the overall structure of the first radiation module, the 1-1th, 2-1th, 3-1th, and 4-1th radiation elements 24-1, 25-1, 26-1, and 27-1 are arranged to form a tetragonal structure as a whole at the outside and the 1-3th, −2-3th, −3-3th, and 4-3 radiation elements 24-3, 25-3, 26-3, and 27-3 are arranged in the overall shape of letter "+".

Here, in the structure of the third embodiment illustrated in FIG. 19, the multiple radiation elements 24-1, 24-3, 25-1, 25-3, 26-1, 26-3, 27-1, and 27-3, which form the first radiation module, are configured to be divided into, for example, 1-1th and 1-3th radiation elements 24-1 and 24-3, 2-1th and 2-3th radiation elements 25-1 and 25-3, 3-1th and 3-3th radiation elements 26-1 and 26-3, and 4-1th and 4-3th radiation elements 27-1 and 27-3, respectively, on the basis of a generated polarized wave. In other words, in the above-described structure, the 1-1th and 1-3th radiation elements 24-1 and 24-3 are implemented so as to be linked with each other to be fed and are configured to generate a first polarized wave. Similarly, the 2-1th and 2-3th radiation elements 25-1 and 25-3 are configured to generate a second polarized wave, the 3-1th and 3-3th radiation elements 26-1 and 26-3 are configured to generate a third polarized wave, and the 4-1th and 4-3th radiation elements 27-1 and 27-3 are configured to generate a fourth polarized wave.

As illustrated in FIGS. 14 to 19, in the structures according to the third embodiment of the present invention and the modified examples thereof, the first radiation module can generate four polarized waves. As described above, an antenna which generates four polarized waves may provide more polarized waves than, for example, a dual polarized antenna generating two polarized waves within a given space, thereby efficiently using the space. Further, for such a reason, the antenna may have an excellent degree of integration in terms of an antenna characteristic.

Further, in the structures illustrated in FIGS. 14 to 19, it has been described that, when the first radiation module which generates four polarized waves according to embodiments of the present invention is configured, second and third radiation modules are included within the installation range of the first radiation module. However, according to another embodiment, a structure in which the second and/or third modules are not included is fully possible.

A multi-band multi-polarized wireless communication antenna according an embodiment of the present invention may be configured and operated as described above. Meanwhile, specified embodiments of the present invention have been described above. However, various modifications may be made without deviating from the scope of the present invention.

For example, as an example of a structure modified from that of the third embodiment in FIG. 14, it is possible to include only two radiation elements inside the radiation module, similar to the modified structure of the first embodiment illustrated in FIG. 7. In addition, one radiation element or three radiation elements can be included inside the first radiation module.

Further, the first, second, and third embodiments have been described above while being distinguished from each other. However, according to another embodiment, at least some characteristics of the embodiments can be combined with each other.

Further, in the above-described structures of the embodiments, for example, a stick-shaped director, which is made of a conductive material, can further be installed at the upper parts of the radiation elements which constitute the first radiation module in directions toward which beams are radiated from locations which are spaced apart from the corresponding radiation elements so as to adjust a radiation characteristic, such as a beam width.

In addition to that, various modifications and variations can be made without departing from the scope of the present invention, and the scope of the present invention shall not be determined by the above-described embodiments and has to be determined by the following claims and equivalents thereof.

As described above, a multi-band multi-polarized wireless communication antenna, according to the present invention, may provide a more optimized structure and size, a stable radiation characteristic, the easy adjustment of beam width, and an easy antenna design.

What is claimed is:

1. A multi-band multi-polarized wireless communication antenna, comprising:

a reflector;

at least one first radiation module of a first band, which is installed on the reflector; and at least one second or third radiation module of a second or third band, which is installed on the reflector, wherein the first radiation module comprises first to eighth radiation elements having a dipole structure, each of the first to eighth radiation elements is configured such that two radiation arms are connected to each other in a shape of a right angle, wherein each of the first to fourth radiation elements is configured such that one of the two radiation arms is configured to be placed along and parallel to a side of the reflector, and the first to fourth radiation elements installed to form a structure in the overall shape of a tetragon, wherein the fifth to eighth radiation elements is included inside the structure in the overall shape of the tetragon of the first to fourth radiation elements, wherein one of the fifth to eighth radiation elements, each of which is configured such that two radiation arms are connected to each other in the shape of the right angle, is included inside the first radiation module, and the fifth to eighth radiation elements are installed to form a structure in the overall shape of a cross, and wherein the second or third radiation module is installed to be included in an installation range between the structure in the overall shape of the tetragon of the first to fourth radiation elements and the structure in the overall shape of the cross of the fifth to eighth radiation elements.

2. The antenna of claim 1, wherein the second or third radiation module is installed on upper and lower right surfaces and on upper and lower left surfaces within the installation range of the first radiation module.

3. The antenna of claim 2, wherein the reflector may be designed not to have an area substantially extending to the outside beyond an installation area of the first to fourth radiation elements of the first radiation module.

4. The antenna of claim 1, further comprising at least one additional radiation module of the first band which is installed on the reflector, and has a structure different from the first radiation module, wherein the at least one additional radiation module may be combined with the first radiation module so as to implement an antenna array of the first band.

5. The antenna of claim 1, wherein a feeding network is formed so that at least some of radiation elements catty-cornered from each other in the first radiation module are linked with each other to generate one among crossed polarized waves, respectively.

6. The antenna of claim 1, wherein the first to fourth radiation elements of the first radiation module forms a feeding network so as to generate first to fourth polarized waves, respectively.

7. A multi-band multi-polarized wireless communication antenna, comprising:

a reflector, a first radiation module that is installed on the reflector and comprises first to fourth radiation elements having a dipole structure, wherein each of the first to fourth radiation elements is configured such that two radiation arms are connected to each other in a shape of a right angle, and one of the two radiation arms is configured to be placed along and parallel to a side of the reflector, wherein the first to fourth elements of the first radiation module form a feeding network so as to generate first to fourth polarized waves, respectively, wherein one of fifth to eighth radiation elements, each of which is configured such that two radiation arms are connected to each other in the shape of the right angle, is included inside the first radiation module, and the fifth to eighth radiation elements installed to form a structure in the overall shape of a cross, and wherein, when the fifth to eighth radiation elements are installed correspondingly to the first to fourth radiation elements respectively, the first and fifth radiation elements configured to be linked so as to generate a first polarized wave, the second and sixth radiation elements configured to be linked so as to generate a second polarized wave, the third and seventh radiation elements configured to be linked so as to generate a third polarized wave, and the fourth and eighth radiation elements configured to be linked so as to generate a fourth polarized wave.

8. A multi-band multi-polarized wireless communication antenna, comprising:

a reflector;

a first radiation module that is installed on the reflector and comprises first to fourth radiation elements having a dipole structure, wherein each of the first to fourth radiation elements is configured such that two radiation arms are connected to each other in a shape of a right angle, and one of the two radiation arms is configured to be placed along and parallel to a side of the reflector, wherein the first to fourth elements of the first radiation module form a feeding network so as to generate first to fourth polarized waves, respectively, wherein one of fifth to eighth radiation elements, each of which is configured such that two radiation arms are connected to each other in the shape of the right angle, is included inside the first radiation module, and the fifth to eighth radiation elements installed to form a structure in the overall shape of a cross, and, wherein, when the fifth to eighth radiation elements are installed correspondingly to the first to fourth radiation elements, respectively, the first and seventh radiation elements configured to be linked so as to generate a first polarized wave, the second and eighth radiation elements configured to be linked so as to generate a second polarized wave, the third and fifth radiation elements configured to be linked so as to generate a third polarized wave, and the fourth and sixth radiation elements configured to be linked so as to generate a fourth polarized wave.

* * * * *